US007800465B2

(12) United States Patent
Kimura et al.

(10) Patent No.: US 7,800,465 B2
(45) Date of Patent: Sep. 21, 2010

(54) PASSIVE COMPONENT

(75) Inventors: Hironobu Kimura, Saku (JP); Takami Hirai, Toyota (JP); Yasuhiko Mizutani, Komaki (JP); Hirotaka Takeuchi, Saku (JP)

(73) Assignee: Soshin Electric Co., Ltd., Saku (JP)

( * ) Notice: Subject to any disclaimer, the term of this patent is extended or adjusted under 35 U.S.C. 154(b) by 213 days.

(21) Appl. No.: 12/064,681

(22) PCT Filed: Sep. 28, 2006

(86) PCT No.: PCT/JP2006/319373

§ 371 (c)(1),
(2), (4) Date: Feb. 25, 2008

(87) PCT Pub. No.: WO2007/040153

PCT Pub. Date: Apr. 12, 2007

(65) Prior Publication Data

US 2009/0134950 A1 May 28, 2009

(30) Foreign Application Priority Data

Sep. 30, 2005 (JP) ..... 2005-288713

(51) Int. Cl.
*H01P 1/203* (2006.01)
*H01P 5/10* (2006.01)

(52) U.S. Cl. ..... 333/204; 333/26

(58) Field of Classification Search ..... 333/4, 333/25, 26, 166, 167, 175, 185, 202, 204, 333/33, 35, 128

See application file for complete search history.

(56) References Cited

U.S. PATENT DOCUMENTS

| | | | | |
|---|---|---|---|---|
| 6,828,881 | B2 * | 12/2004 | Mizutani et al. | 333/204 |
| 6,850,127 | B2 * | 2/2005 | Sakakura et al. | 333/25 |
| 7,138,884 | B2 * | 11/2006 | Cheung et al. | 333/26 |
| 2003/0020568 | A1 | 1/2003 | Mizutani et al. | |
| 2003/0025571 | A1 | 2/2003 | Maekawa et al. | |
| 2003/0141948 | A1 | 7/2003 | Maekawa et al. | |
| 2006/0077020 | A1 * | 4/2006 | Wang et al. | 333/204 |

FOREIGN PATENT DOCUMENTS

| | | | |
|---|---|---|---|
| JP | 10-200305 | A1 | 7/1998 |
| JP | 2002-280805 | A1 | 9/2002 |
| JP | 2003-087008 | A1 | 3/2003 |
| JP | 2004-056745 | A1 | 2/2004 |
| JP | 2005-159512 | A1 | 6/2005 |

* cited by examiner

*Primary Examiner*—Benny Lee
*Assistant Examiner*—Gerald Stevens
(74) *Attorney, Agent, or Firm*—Burr & Brown

(57) ABSTRACT

A passive component is provided with a filter section employing a nonequilibrium input/output system, which has an input side resonator connected to a nonequilibrium input terminal, and an output side resonator coupled with the input side resonator; and a converting section having two double line coupled lines. An output stage of the filter section is connected with an input stage of the converting section through a first capacitor, and an input stage of the filter section is connected with the input stage of the converting section through a second capacitor. Namely, the second capacitor functions as a jump capacitor. The position of an attenuation pole is permitted to be adjusted by a second capacitor in a region low in frequency characteristics.

5 Claims, 8 Drawing Sheets

PASSIVE COMPONENT

TECHNICAL FIELD

The present invention relates to a passive component such as a multilayered dielectric filter for resonant circuits for use in a microwave band ranging from several hundred MHz to several GHz, and more particularly to a passive component which is effective to make communication devices and electronic devices small in size.

BACKGROUND OF THE INVENTION

Recently, semiconductor components such as ICs have become highly integrated and have quickly become smaller in size. Passive components such as filters for use with semiconductor devices have also become smaller in size. Multilayered dielectric filters employing dielectric substrates are effective to make passive components smaller in size (see, for example, Patent Documents 1 and 2).

Generally, it has been proposed to integrally combine a filter and an unbalanced to balanced converter in a dielectric substrate (see, for example, Patent document 3).

Passive components for use in different environments are classified into passive components having gradual attenuation characteristics and a wide passband, and passive components having a narrow passband and sharp attenuation characteristics.

Generally, passive components such as filters for use in a microwave band ranging from several hundred MHz to several GHz have an unbalanced signal input/output system with a reference potential provided by ground potential.

For connecting a balanced-input semiconductor component such as an IC circuit, for example, to such a passage component, a balun (unbalanced to balanced converter) must be used, which poses limitations on efforts to reduce the size of the passage components.

For assembling an unbalanced to balanced converter in a dielectric substrate, the layout of the filter and the unbalanced to balanced converter within the dielectric substrate is of important concern.

Patent Document 1: Japanese Laid-Open Patent Publication No. 2002-280805

Patent Document 2: Japanese Laid-Open Patent Publication No. 2005-159512

Patent Document 3: Japanese Laid-Open Patent Publication No. 2004-056745

SUMMARY OF THE INVENTION

The present invention has been made in view of the above problems. It is an object of the present invention to provide a passive component, which is of a simple structure, is capable of adjusting attenuation characteristics in a low range of frequency characteristics, and which can be used in various environments. Another object of the present invention is to provide a passive component having a large attenuation level in a blocking range of a filter, so as to provide sharp attenuation characteristics even if the filter and an unbalanced to balanced converter are integrally combined with each other in a dielectric substrate.

A passive component according to the present invention comprises a filter according to an unbalanced input/unbalanced output system, having at least one resonator and an unbalanced to balanced converter, wherein an output stage of the filter and an input stage of the unbalanced to balanced converter are connected to each other through a first capacitor, and an input stage of the filter and the input stage of the unbalanced to balanced converter are connected to each other through a second capacitor.

If the output stage of the filter and the input stage of the unbalanced to balanced converter are directly connected to each other, then the filter and the unbalanced to balanced converter cause unwanted matching in an attenuation range of the pass characteristics, thereby producing an unwanted peak in the attenuation range. According to the present invention, since the filter is connected to the unbalanced to balanced converter through the first capacitor, the first capacitor changes the phase of the unbalanced to balanced converter in order to prevent unwanted matching with the filter.

The position of an attenuation pole in a low range of frequency characteristics is adjustable by the second capacitor. Therefore, the passive component can easily provide various frequency characteristics, such as gradual attenuation characteristics and a wide passband, as well as a narrow passband and sharp attenuation characteristics. The passive component is of a simple structure and can be used in various environments.

The passive component may comprise a plurality of electrodes making up the filter, a plurality of striplines making up the unbalanced to balanced converter, a first capacitor electrode providing a capacitive coupling between the electrode of the output stage of the filter and the stripline of the input stage of the unbalanced to balanced converter, and a second capacitor electrode providing a capacitive coupling between the electrode of the input stage of the filter and the stripline of the input stage of the unbalanced to balanced converter, wherein these elements are disposed in a dielectric substrate made up of a plurality of stacked dielectric layers.

The passive component is reduced in size because the filter according to the unbalanced input/unbalanced output system having the resonators, and the converter having the striplines, are integrally combined with each other in the dielectric substrate.

Since the filter and the unbalanced to balanced converter are integrally combined with each other, the characteristic impedance between the filter and the unbalanced to balanced converter does not need to be set to a particular value (e.g., 50 Ω), but may be set to a desired value, and therefore the filter and the unbalanced to balanced converter can be designed with increased freedom. Since the characteristic impedance between the filter and the unbalanced to balanced converter can be set to a low value, the filter can easily be produced and the line widths of the striplines of the unbalanced to balanced converter can be increased, thereby allowing the unbalanced to balanced converter to exhibit a reduced loss.

If the electrode of the input stage of the filter comprises an input resonator electrode of an input resonator, and the electrode of the output stage of the filter comprises an output resonator electrode of an output resonator, then the first capacitor electrode may face toward the output resonator electrode with one of the dielectric layers interposed therebetween, whereas the second capacitor electrode may face toward the input resonator electrode with one of the dielectric layers interposed therebetween.

Consequently, the first capacitor can be provided by the first capacitor electrode between the output stage of the filter and the input stage of the unbalanced to balanced converter, whereas the second capacitor can be provided by the second capacitor electrode between the input stage of the filter and the input stage of the unbalanced to balanced converter.

The area of the second capacitor electrode may be changed in order to easily adjust the position of the attenuation pole in the low range of the frequency characteristics.

The first capacitor electrode and the second capacitor electrode may be disposed on different respective dielectric layers, wherein the first capacitor electrode and the second capacitor electrode are electrically connected to each other through a via hole.

An innerlayer ground electrode may be disposed between the stripline of the input stage of the unbalanced to balanced converter and the first and second capacitor electrodes. If the first capacitor electrode and the second capacitor electrode are disposed on the side of the unbalanced to balanced converter, then coupling of the first capacitor electrode and the second capacitor electrode to the unbalanced to balanced converter might occur, possibly impairing the pass characteristics. However, the passive component according to the present invention does not impair the pass characteristics, because the innerlayer ground electrode is interposed between the input stage of the unbalanced to balanced converter and the first and second capacitor electrodes.

In the above passive component, the filter according to the unbalanced input/unbalanced output system having the plural resonators, and the unbalanced to balanced converter having the striplines, may be integrally combined with each other within the dielectric substrate made up of the dielectric layers. Also, the unbalanced to balanced converter may be disposed in an upper region of the dielectric substrate along a stacking direction of the dielectric layers, whereas the filter may be disposed in a lower region of the dielectric substrate along the stacking direction of the dielectric layers.

With the above arrangement, the filter may comprise ¼-wavelength resonators, which are advantageous in terms of their small size. Therefore, the filter may be smaller in size than a balanced stacked dielectric filter made up of ½-wavelength resonators.

According to the present invention, in particular, the unbalanced to balanced converter is disposed in an upper region of the dielectric substrate along the stacking direction of the dielectric layers, and the filter is disposed in a lower region of the dielectric substrate along the stacking direction of the dielectric layers. Therefore, the passive component, with the filter and the unbalanced to balanced converter being integrally combined in the dielectric substrate, can exhibit a large attenuation level in a blocking range, so as to provide sharp attenuation characteristics for improved performance.

The dielectric layers of the dielectric substrate may comprise dielectric materials of different types. Since the dielectric layers are stacked, a dielectric layer having a high dielectric constant may be used where a strong electromagnetic coupling is provided, and a dielectric layer having a low dielectric constant may be used where a weak electromagnetic coupling is provided. By using materials having desired dielectric constants, freedom with respect to thickness is increased, thereby enabling a low-profile passive component.

For example, the dielectric constant of the dielectric layers of the filter may be higher than the dielectric constant of the dielectric layers utilized in the unbalanced to balanced converter. The electrode area of the filter can thus be reduced, in order to decrease stray coupling in the unbalanced to balanced converter.

The passive component according to the present invention has a simple structure, is capable of adjusting attenuation characteristics in a low range of frequency characteristics, and can be used in various environments.

DETAILED DESCRIPTION OF THE INVENTION

A passive component according to an embodiment of the present invention shall be described below with reference to FIGS. 1 through 8.

Figure 1:
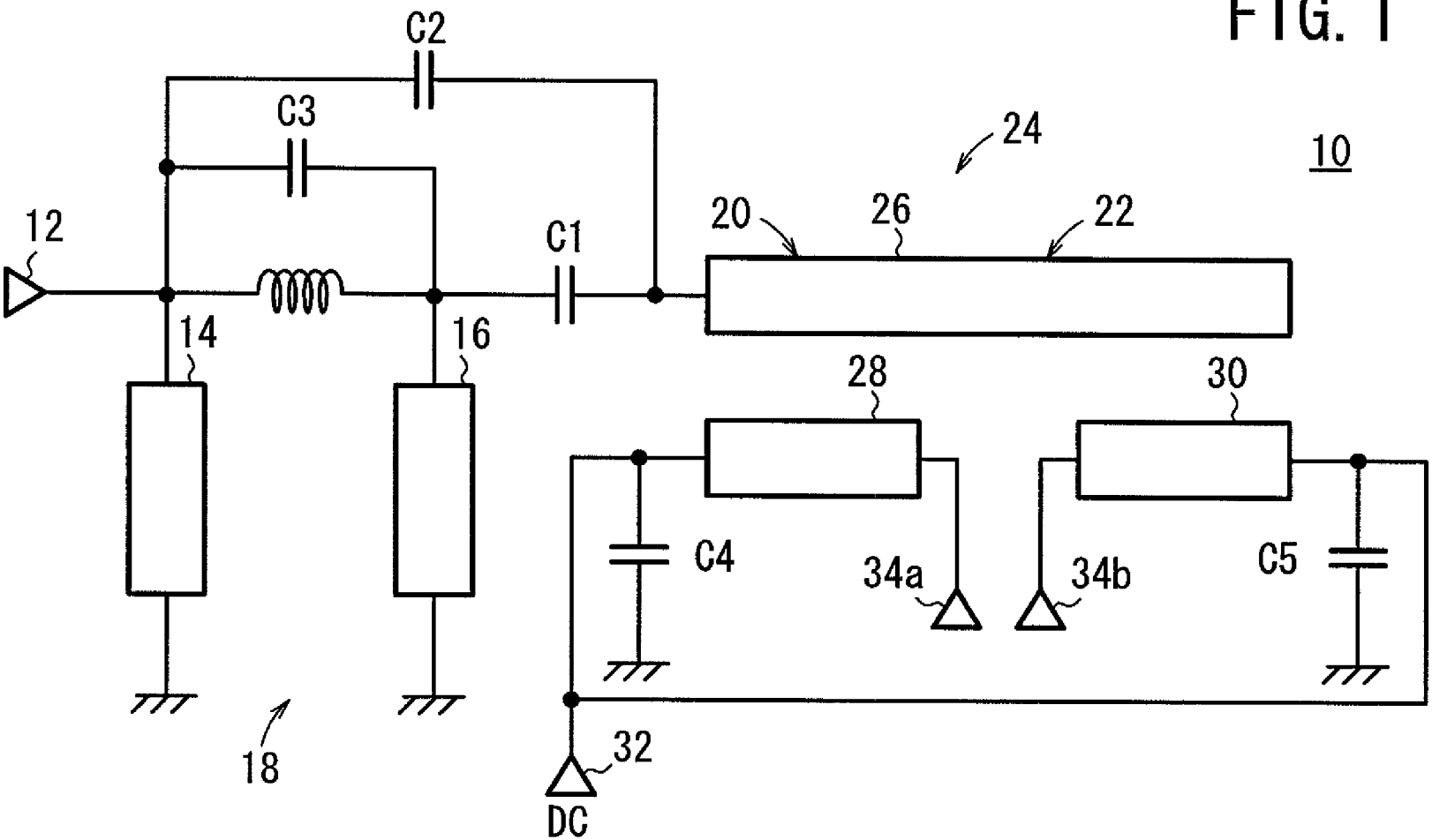
FIG. 1 is an equivalent circuit diagram of a passive component according to an embodiment of the present invention.

As shown in FIG. 1, the passive component 10 according to the embodiment comprises a filter 18 according to an unbalanced input/unbalanced output system, having an input resonator 14 connected to an unbalanced input terminal 12, an output resonator 16 coupled to the input resonator 14, and an unbalanced to balanced converter (hereinafter referred to as "converter") 24 having two coupling dual-lines (a first coupling dual-line 20 and a second coupling dual-line 22).

The output stage of the filter 18 and the input stage of the converter 24 are connected to each other by a first capacitor C1. The input stage of the filter 18 and the input stage of the converter 24 are connected to each other by a second capacitor C2. The second capacitor C2 functions as a jump capacitor.

The converter 24 has a first line 26, a second line 28, and a third line 30. The first line 26 has one end thereof connected to the output stage of the filter 18 through the first capacitor C1 and also to the input stage of the filter 18 through the second capacitor C2. The other end of the first line 26 is open. The second line 28 has one end thereof connected to a DC terminal 32, and another end thereof connected to a first balanced output terminal 34*a*. The third line 30 has one end thereof connected to the DC terminal 32, and another end thereof connected to a second balanced output terminal 34*b*. The first line 26 and the second line 28 make up a first coupling dual-line 20, whereas the first line 26 and the third line 30 make up a second coupling dual-line 22.

If the output stage of the filter 18 and the input stage of the converter 24 are directly connected to each other, then the filter 18 and the converter 24 cause unwanted matching in an attenuation range of the pass characteristics, thereby producing an unwanted peak in the attenuation range.

According to the present embodiment, however, since the filter 18 is connected to the converter 24 through the first capacitor C1, the first capacitor C1 changes the phase of the converter 24 in order to prevent unwanted matching with the filter 18.

Figure 2:
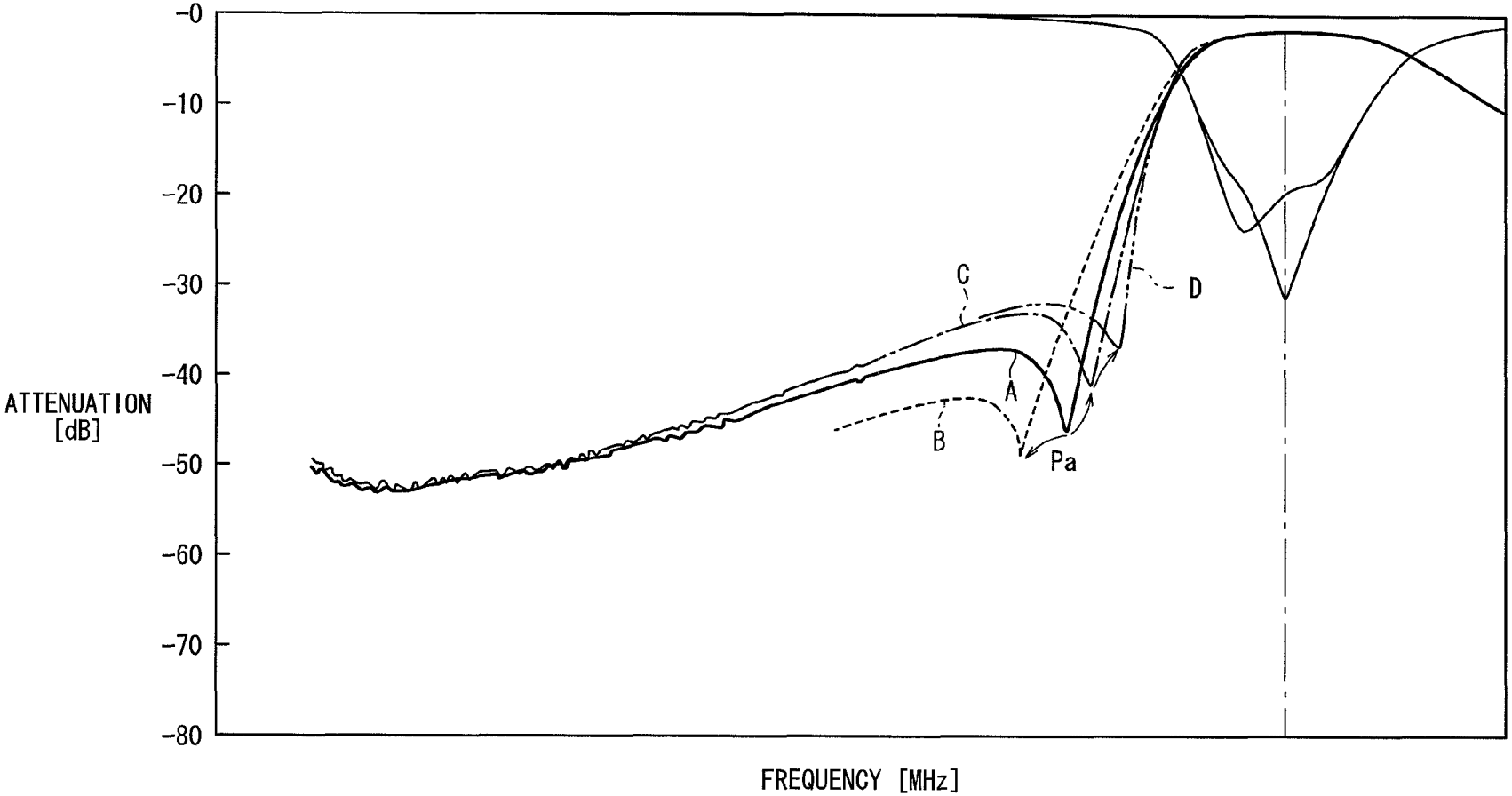
FIG. 2 is a diagram showing how the frequency characteristics of the passive component according to the embodiment change, in particular due to the presence of a second capacitor.

The second capacitor C2 makes it possible to adjust the position of an attenuation pole in a low range of the frequency characteristics. For example, if the passive component, which is fabricated to certain design specifications, has a solid-line frequency characteristic curve A as shown in FIG. 2, then when the capacitance of the second capacitor C2 is reduced, the attenuation pole Pa in the low range is shifted away from the central frequency fc, as indicated by the broken-line curve B. In this case, the passive component exhibits gradual attenuation characteristics and a wide passband.

When the capacitance of the second capacitor C2 is increased, the attenuation pole Pa in the low range is shifted toward the central frequency fc, as indicated by the dot-and-dash-line curve C and the two-dot-and-dash-line curve D. In this case, the passive component exhibits a narrow passband and sharp attenuation characteristics.

Specific examples wherein the passive component 10 is incorporated in a single dielectric substrate 40 shall be described below with reference to FIGS. 3 through 8.

Figure 3:
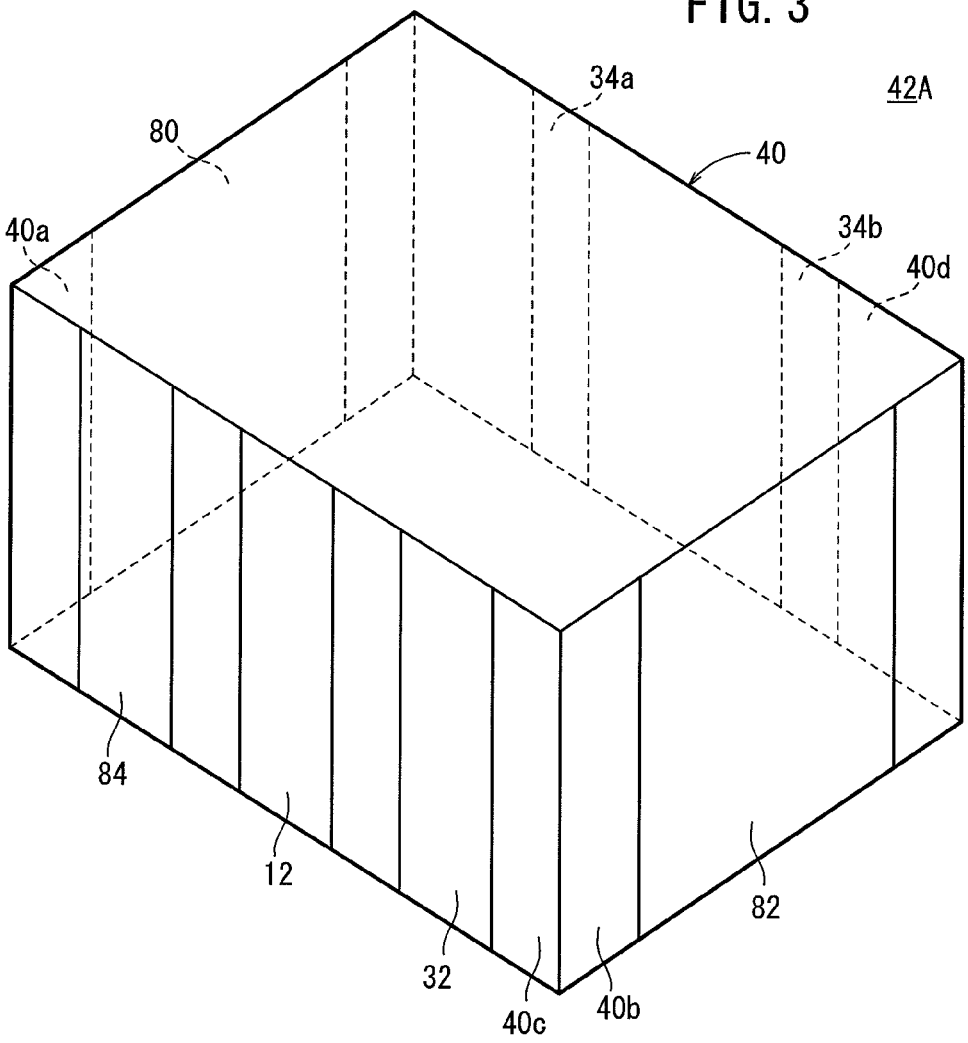
FIG. 3 is a partially transparent perspective view of a passive component according to a first specific example.
Figure 4:
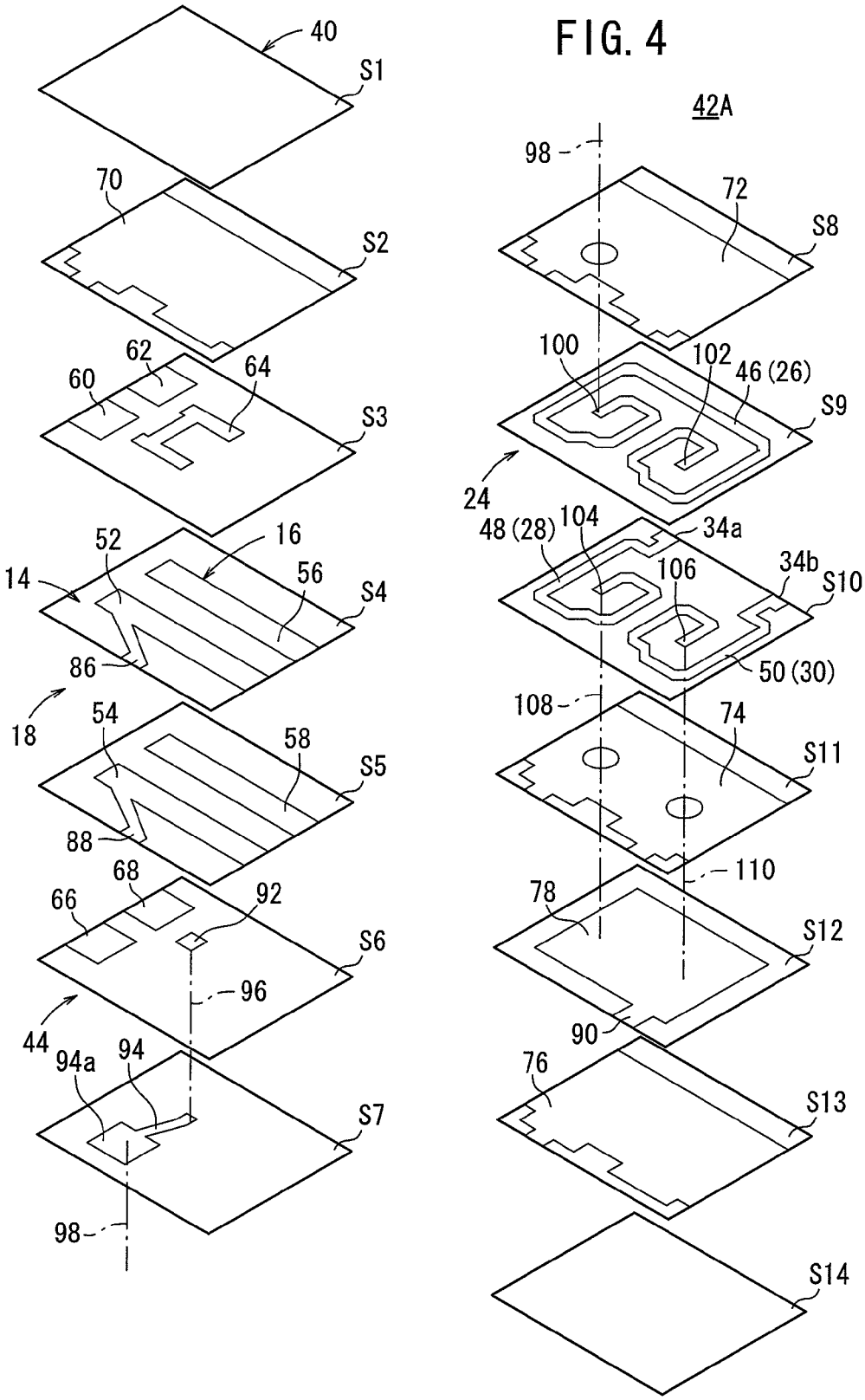
FIG. 4 is an exploded perspective view of the passive component according to the first specific example.

As shown in FIGS. 3 and 4, a passive component 42A according to a first specific example has an integral dielectric substrate 40, comprising a plurality of dielectric layers (S1-S14: see FIG. 4), which are stacked and sintered together.

As shown in FIG. 4, the dielectric substrate 40 is constructed by stacking the first through fourteenth dielectric layers S1-S14 successively from above. Each of the first through fourteenth dielectric layers S1-S14 comprises a single layer or a plurality of layers.

The dielectric substrate 40 includes the filter 18, the converter 24, and a connector 44 connecting the filter 18 and the converter 24 to each other.

The filter 18 comprises two ¼-wavelength resonators (the input resonator 14 and the output resonator 16). The converter 24 has a first stripline electrode 46 serving as the first line 26, a second stripline electrode 48 serving as the second line 28, and a third stripline electrode 50 serving as the third line 30.

The input resonator 14 of the filter 18 comprises a first input resonator electrode 52 disposed on a principal surface of the fourth dielectric layer S4, and a second input resonator electrode 54 disposed on a principal surface of the fifth dielectric layer S5. The output resonator 16 comprises a first output resonator electrode 56 disposed on the principal surface of the fourth dielectric layer S4, and a second output resonator electrode 58 disposed on the principal surface of the fifth dielectric layer S5.

A principal surface of the third dielectric layer S3 supports an innerlayer ground electrode 60 thereon, which faces toward an open end of the first input resonator electrode 52, an innerlayer ground electrode 62 facing an open end of the first output resonator electrode 56, and a coupling adjustment electrode 64, which adjusts the degree of coupling between the input resonator 14 and the output resonator 16.

A principal surface of the sixth dielectric layer S6 supports an innerlayer ground electrode 66 thereon, which faces toward an open end of the second input resonator electrode 54, an innerlayer ground electrode 68 facing an open end of the second output resonator electrode 58, and a first capacitor electrode 92 of the connector 44.

The filter 18 and the converter 24 are disposed in respective regions that are separated vertically from each other along the direction in which the first through fourteenth dielectric layers S1-S14 are stacked. The filter 18 is disposed in an upper region along the stacking direction, whereas the converter 24 is disposed in a lower region along the stacking direction, with the connector 44 being interposed therebetween.

The filter 18 is disposed within the third dielectric layer S3 through the fifth dielectric layer S5. The converter 24 is disposed within the ninth dielectric layer S9 and the tenth dielectric layer S10. The connector 44 is disposed within the sixth dielectric layer S6 and the seventh dielectric layer S7.

The passive component 42A includes innerlayer ground electrodes 70, 72, 74, 76 disposed on respective principal surfaces of the second dielectric layer S2, the eighth dielectric layer S8, the eleventh dielectric layer S11, and the thirteenth dielectric layer S13. Further, the passive component 42A has a DC electrode 78 disposed on a principal surface of the twelfth dielectric layer S12. The innerlayer ground electrode 72 is an electrode that isolates the filter 18 and the converter 24 from each other.

As shown in FIG. 3, a ground electrode 80 connected to the innerlayer ground electrodes 60, 62, 66, 68, 70, 72, 74, 76 is disposed on a first side surface 40*a* among the outer peripheral surfaces of the dielectric substrate 40. A ground electrode 82, which is connected to the innerlayer ground electrodes 70, 72, 74, 76, to respective ends (short-circuiting ends) of the first input resonator electrode 52 and the second input resonator electrode 54, and to respective ends (short-circuiting ends) of the first output resonator electrode 56 and the second output resonator electrode 58, is disposed on a second side surface 40*b* arranged oppositely to the first side surface 40*a*.

A ground electrode 84, the unbalanced input terminal 12, and the DC terminal 32, which are connected to the innerlayer ground electrodes 70, 72, 74, 76, are disposed on a third side surface 40*c* of the dielectric substrate 40. As shown in FIG. 4, the unbalanced input terminal 12 is electrically connected to the first input resonator electrode 52 and to the second input resonator electrode 54 through lead electrodes 86, 88. The DC terminal 32 forms a terminal to which a DC voltage is applied from an external power supply, not shown, and is electrically connected to the DC electrode 78 through a lead electrode 90.

As shown in FIG. 4, a first capacitor electrode 92 underlying the second output resonator electrode 58, with the fifth dielectric layer S5 interposed therebetween, is disposed on the principal surface of the sixth dielectric layer S6.

A second capacitor electrode 94, connecting the output stage of the filter 18 and the input stage of the converter 24 to each other, is disposed on a principal surface of the seventh dielectric layer S7. The first capacitor electrode 92 is electrically connected to the second capacitor electrode 94 by a via hole 96 defined in the sixth dielectric layer S6.

The second capacitor electrode 94 has one end connected to the via hole 96 and another end underlying the second input resonator electrode 54, with the fifth dielectric layer S5 and the sixth dielectric layer S6 being interposed therebetween. The second capacitor electrode 94 is connected to a via hole 98 extending into the converter 24. The first capacitor electrode 92, the second capacitor electrode 94, and the via holes 96, 98 collectively make up the connector 44.

The first stripline electrode 46 of the converter 24 is disposed on a principal surface of the ninth dielectric layer S9. The second stripline electrode 48 and the third stripline electrode 50 of the converter 24 are disposed on a principal surface of the tenth dielectric layer S10.

The first stripline electrode 46 has one end 100 and another end 102 thereof, which are disposed adjacent to each other, and has a substantially spiral or tortuous symmetrical shape extending from the one end 100 toward the other end 102.

The second stripline electrode 48 has a spiral or tortuous shape extending from one end 104 toward the first balanced output terminal 34*a*. The third stripline electrode 50 has a spiral or tortuous shape extending from one end 106 toward the second balanced output terminal 34*b*. The second stripline electrode 48 and the third stripline electrode 50 are disposed symmetrically.

The one end 100 of the first stripline electrode 46 is electrically connected to the other end of the second capacitor electrode 94 through the via hole 98, which extends through the seventh dielectric layer S7 and the eighth dielectric layer S8. The other end 102 of the first stripline electrode 46 remains open. The innerlayer ground electrode 72 has a region that is insulated from the via hole 98, namely, a region where an electrode film is not provided thereon.

The one end 104 of the second stripline electrode 48 and the one end 106 of the third stripline electrode 50 are electrically connected to the DC electrode 78 through via holes 108, 110 that extend through the tenth dielectric layer S10 and the eleventh dielectric layer S11. The innerlayer ground electrode 74 has a region that is insulated from the via holes 108, 110, namely, a region where an electrode film is not provided thereon.

As illustrated in the equivalent circuit diagram shown in FIG. 1, the coupling adjustment electrode 64 provides a coupling capacitor C3, which is connected between the input resonator 14 and the output resonator 16. The second output resonator electrode 58 and the first capacitor electrode 92, which face each other with the fifth dielectric layer S5 interposed therebetween, serve as the first capacitor C1. The second input resonator electrode 54 and the second capacitor electrode 94, which face each other with the fifth dielectric layer S5 and the sixth dielectric layer S6 interposed therebetween, serve as the second capacitor C2.

Since the respective ends 104, 106 of the second stripline electrode 48 and the third stripline electrode 50 are connected to the DC electrode 78 through the respective via holes 108, 110, the respective ends of the second line 28 and the third line 30 of the converter 24 are connected commonly to the DC terminal 32. Since the innerlayer ground electrodes 74, 76 are disposed above and below the DC electrode 78, capacitors C4, C5 are provided between the second line 28 and GND as well as between the third line 30 and GND.

With the passive component 10 according to the present embodiment, since the filter 18 is connected to the converter 24 through the first capacitor C1, the first capacitor C1 changes the phase of the converter 24 so as to prevent unwanted matching with the filter 18.

The second capacitor C2 makes it possible to adjust the position of the attenuation pole Pa within a low range of the frequency characteristics. Therefore, the passive component 10 can easily provide various frequency characteristics, such as gradual attenuation characteristics and a wide passband, and a narrow passband and sharp attenuation characteristics. The passive component 10 has a simple structure and can be used in various environments.

The passive component 42A according to the first specific example is reduced in size, because the filter 18 according to the unbalanced input/unbalanced output system, having the input resonator 14 and the output resonator 16, and the converter 24 having the first through third striplines 46, 48, 50, are combined integrally with each other within the dielectric substrate 40.

Since the filter 18 and the converter 24 are integrally combined with each other, the characteristic impedance between them does not need to be set to any particular value (e.g., 50 Ω), but may be set to a desired value, and thus the filter 18 and the converter 24 can be designed with increased freedom. Since the characteristic impedance between the filter 18 and the converter 24 can be set to a low value, the filter 18 can easily be produced, and the line widths of the first through third striplines 46, 48, 50 of the converter 24 can be increased, thereby allowing the converter 24 to have a reduced loss.

In the connector 44, the first capacitor electrode 92 faces the second output resonator electrode 58 with the fifth dielectric layer S5 interposed therebetween, whereas the second capacitor electrode 94 faces the second input resonator electrode 54 with the fifth dielectric layer S5 and the sixth dielectric layer S6 interposed therebetween. Consequently, the first capacitor C1 can easily be provided between the output resonator 16 of the filter 18 and the input stage of the converter 24. Also, the second capacitor C2 can easily be provided between the input resonator 14 of the filter 18 and the input stage of the converter 24.

The area of a portion 94*a* of the second capacitor electrode 94, which faces the second input resonator electrode 54, and the dielectric constant of the fifth dielectric layer S5 and/or the sixth dielectric layer S6, may be changed in order to adjust the position of the attenuation pole Pa in the low range of the frequency characteristics with ease.

The first stripline electrode 46 of the converter 24 and the second capacitor electrode 94 might unnecessarily be coupled to each other, possibly impairing the pass characteristics. However, the passive component 42A according to the first specific example does not impair the pass characteristics, because the innerlayer ground electrode 72 is interposed between the first stripline electrode 46 of the converter 24 and the second capacitor electrode 94.

If the coupling adjustment electrode 64 were disposed in the vicinity of the first capacitor electrode 92, then stray coupling could be formed and the above unwanted matching might not be eliminated. According to the present specific example, however, the coupling adjustment electrode 64 is disposed at a position remote from the first capacitor electrode 92. Namely, the coupling adjustment electrode 64 is disposed on the third dielectric layer S3 with the fourth dielectric layer S4 and the fifth dielectric layer S5 interposed therebetween, which support thereon the first input resonator electrode 52 and the second input resonator electrode 54 and the first output resonator electrode 56 and the second output resonator electrode 58. As a result, unwanted matching between the filter 18 and the converter 24 is eliminated, thereby improving the frequency characteristics. The unbalanced input terminal 12 may be connected to the first input resonator electrode 52 and the second input resonator electrode 54 directly by the lead electrodes 86, 88 (tap coupling), or by capacitors.

In the specific example, the first stripline electrode 46, the second stripline electrode 48, and the third stripline electrode 50, which are electromagnetically coupled, each have a spiral or tortuous symmetrical shape, providing balanced phase and amplitude characteristics. As a result, it is possible to provide an unbalanced input/balanced output filter having better attenuation characteristics than unbalanced input/output filters.

The ends 104, 106 of the second stripline electrode 48 and the third stripline electrode 50 of the converter 24 are connected to the DC electrode 78 through the respective via holes 108, 110, while the DC electrode 48 is disposed in facing relation to the upper innerlayer ground electrode 74 and the lower innerlayer ground electrode 76. Therefore, the capacitors C4, C5 (see FIG. 1) are provided between the DC terminal 32 and GND. Since the capacitors C4, C5 function as capacitors for reducing common-mode noise, an external capacitor for reducing common-mode noise is unnecessary and may be eliminated.

The innerlayer ground electrodes 74, 76, which are disposed above and below the DC electrode 78, are effective to reduce adverse effects from outside and inside of the passive component, thereby improving isolation characteristics and enabling more stable characteristics.

The balance between phase and amplitude in the frequency characteristics can be adjusted by changing the area of the DC electrode 78 and by translating the positions of the via holes 108, 110, which electrically connect the ends 104, 106 of the second stripline electrode 48 and the third stripline electrode 50 of the converter 24 to the DC electrode 78.

In the above example, the filter comprises two resonators. However, the filter may also comprise one resonator, or three or more resonators.

A passive component 42B according to a second specific example shall be described below with reference to FIGS. 5 through 8. Parts of the passive component 42B that are identical to those of the passive component 42A according to the first specific example are denoted using identical reference characters.

Figure 5:
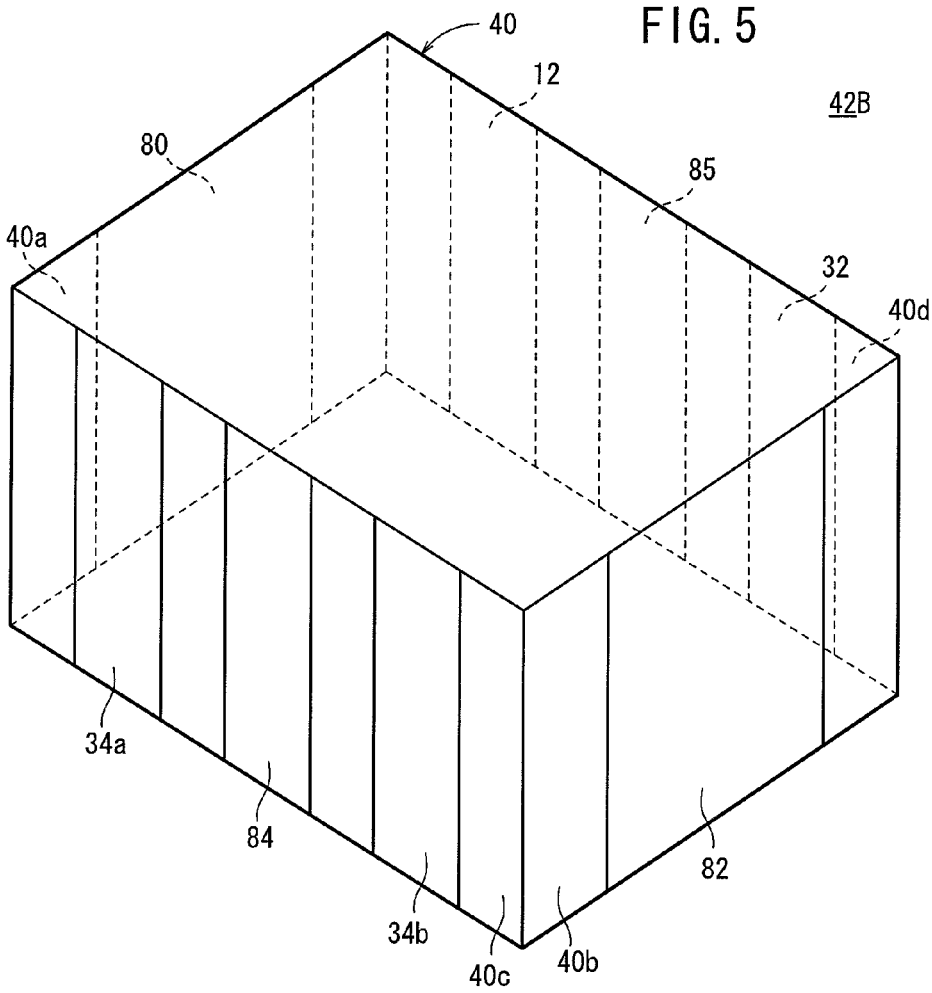
FIG. 5 is a partially transparent perspective view of a passive component according to a second specific example.
Figure 6:
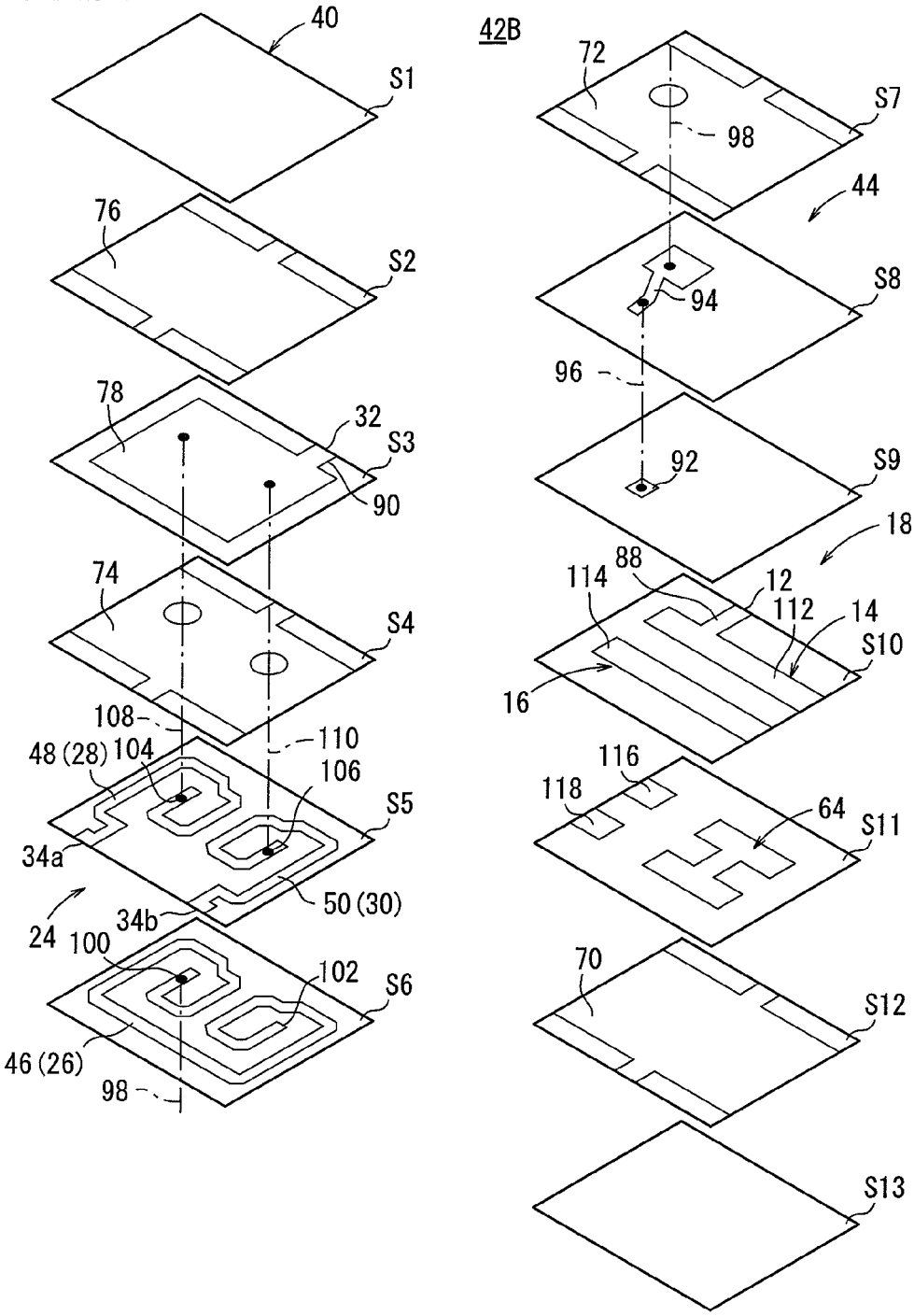
FIG. 6 is an exploded perspective view of the passive component according to the second specific example.

The passive component 42B according to the second specific example is basically similar to the passive component 42A (see FIGS. 3 and 4) according to the first specific example, but differs therefrom in that, as shown in FIGS. 5 and 6, the dielectric substrate 40 comprises first through thirteenth stacked dielectric layers S1-S13. Also, the locations of parts within the dielectric substrate 40 are opposite to the locations of parts of the passive component 42A along the stacking direction of the first through thirteenth dielectric layers S1-S13.

The converter 24 includes a first stripline electrode 46 disposed on a principal surface of the sixth dielectric layer S6, and a second stripline electrode 48 and a third stripline electrode 50, which are disposed on a principal surface of the fifth dielectric layer S5.

The input resonator 14 of the filter 18 comprises an input resonator electrode 112 disposed on a principal surface of the tenth dielectric layer S10. The output resonator 16 comprises an output resonator electrode 114 disposed on a principal surface of the tenth dielectric layer S10.

A principal surface of the eleventh dielectric layer S11 supports thereon an innerlayer ground electrode 116 facing an open end of the input resonator electrode 112, an innerlayer ground electrode 118 facing an open end of the output resonator electrode 114, and a coupling adjustment electrode 64 for adjusting the degree of coupling between the input resonator 14 and the output resonator 16.

The filter 18 and the converter 24 are disposed in respective regions that are vertically separated from each other along the stacking direction of the first through thirteenth dielectric layers S1-S13. The converter 24 is disposed in the upper region along the stacking direction, whereas the filter 18 is disposed in the lower region along the stacking direction, with the connector 44 being interposed therebetween.

The converter 24 is disposed within the fifth dielectric layer S5 through the sixth dielectric layer S6. The filter 18 is disposed within the tenth dielectric layer S10 and the eleventh dielectric layer S11. The connector 44 is disposed within the eighth dielectric layer S8 and the ninth dielectric layer S9.

The passive component 42B includes innerlayer ground electrodes 76, 74, 72, 74, which are disposed on respective principal surfaces of the second dielectric layer S2, the fourth dielectric layer S4, the seventh dielectric layer S7, and the twelfth dielectric layer S12, and a DC electrode 78 disposed on a principal surface of the third dielectric layer S3.

As shown in FIG. 5, a ground electrode 80, which is connected to the innerlayer ground electrodes 70, 72, 74, 76, 116, 118, is disposed on a first side surface 40*a* among the outer peripheral surfaces of the dielectric substrate 40. A ground electrode 82, which is connected to the innerlayer ground electrodes 70, 72, 74, 76, and to respective ends (short-circuiting ends) of the input resonator electrode 112 and the input resonator electrode 114, is disposed on a second side surface 40*b*, which is opposite to the first side surface 40*a*.

A ground electrode 84, a first balanced output terminal 34*a*, and a second balanced output terminal 34*b*, which are connected to the innerlayer ground electrodes 70, 72, 74, 76, are disposed on a third side surface 40*c* of the dielectric substrate 40.

A ground electrode 85, a DC terminal 32, and an unbalanced input terminal 12, which are connected to the innerlayer ground electrodes 70, 72, 74, 76, are disposed on a fourth side surface 40*d*, which is opposite to the third side surface 40*c*.

As shown in FIG. 6, the unbalanced input terminal 12 is electrically connected to the input resonator electrode 12 through a lead electrode 88. The DC terminal 32 forms a terminal to which a DC voltage is applied from an external power supply, not shown, and is electrically connected to the DC electrode 78 through a lead electrode 90.

As shown in FIG. 6, a first capacitor electrode 92 overlying the output resonator electrode 114, with the ninth dielectric layer S9 interposed therebetween, is disposed on a principal surface of the ninth dielectric layer S9.

A second capacitor electrode 94, connecting the output stage of the filter 18 and the input stage of the converter 24 to each other, is disposed on a principal surface of the eighth dielectric layer S8. The first capacitor electrode 92 is electrically connected to the second capacitor electrode 94 by a via hole 96 defined in the eighth dielectric layer S8.

The second capacitor electrode 94 has one end connected to the via hole 96 and another end, which forms a portion 94*a* facing the input resonator electrode 112, overlying the input resonator electrode 112, with the eighth dielectric layer S8 and the ninth dielectric layer S9 interposed therebetween. The second capacitor electrode 94 is connected to a via hole 98 extending into the converter 24.

The first stripline electrode 46 of the converter 24 is disposed on a principal surface of the sixth dielectric layer S6. The second stripline electrode 48 and the third stripline electrode 50 of the converter 24 are disposed on a principal surface of the fifth dielectric layer S5.

The first stripline electrode 46 has one end 100 and another end 102 thereof which are disposed adjacent to each other, and further has a substantially spiral or tortuous symmetrical shape, extending from the one end 100 toward the other end 102.

The second stripline electrode 48 has a spiral or tortuous shape extending from one end 104 toward the first balanced output terminal 34*a*. The third stripline electrode 50 has a spiral or tortuous shape extending from one end 106 toward the second balanced output terminal 34*b*. The second stripline electrode 48 and the third stripline electrode 50 are disposed symmetrically.

The one end 100 of the first stripline electrode 46 is electrically connected to the other end of the second capacitor electrode 94 through the via hole 98, which extends through the sixth dielectric layer S6 and the seventh dielectric layer S7. The other end 102 of the first stripline electrode 46 remains open. The innerlayer ground electrode 72 has a region that is insulated from the via hole 98, namely, a region where an electrode film is not provided thereon.

The one end 104 of the second stripline electrode 48 and the one end 106 of the third stripline electrode 50 are connected electrically to the DC electrode 78 through via holes 108, 110 extending through the third dielectric layer S3 and the fourth dielectric layer S4. The innerlayer ground electrode 74 has a region that is insulated from the via holes 108, 110, namely, a region where an electrode film is not provided thereon.

The passive component 42B according to the second specific example offers the following advantages, in addition to the advantages of the passive component 42A according to the first specific example:

The converter 24 is disposed in an upper region of the dielectric substrate 40 along the stacking direction of the dielectric layers, whereas the filter 18 is disposed in a lower region of the dielectric substrate 40 along the stacking direction of the first through thirteenth dielectric layers S1 through S13. Since a ground surface (substantially at zero potential) wired or placed outside of the passive component 42B is wired or placed on or around the lower region of the passive component 42B, the filter 18 disposed in the lower region of the dielectric substrate 40 of the passive component 42B along the stacking direction is positioned closely to the ground surface. Therefore, the innerlayer ground electrodes 70, 20 of the filter 18 are held closely at a zero potential, such that the filter 18 is well grounded and thus exhibits improved characteristics.

An experimental example shall be described below. The experimental example indicates measured attenuation characteristics of a comparative example together with those of an inventive example.

Figure 7A:
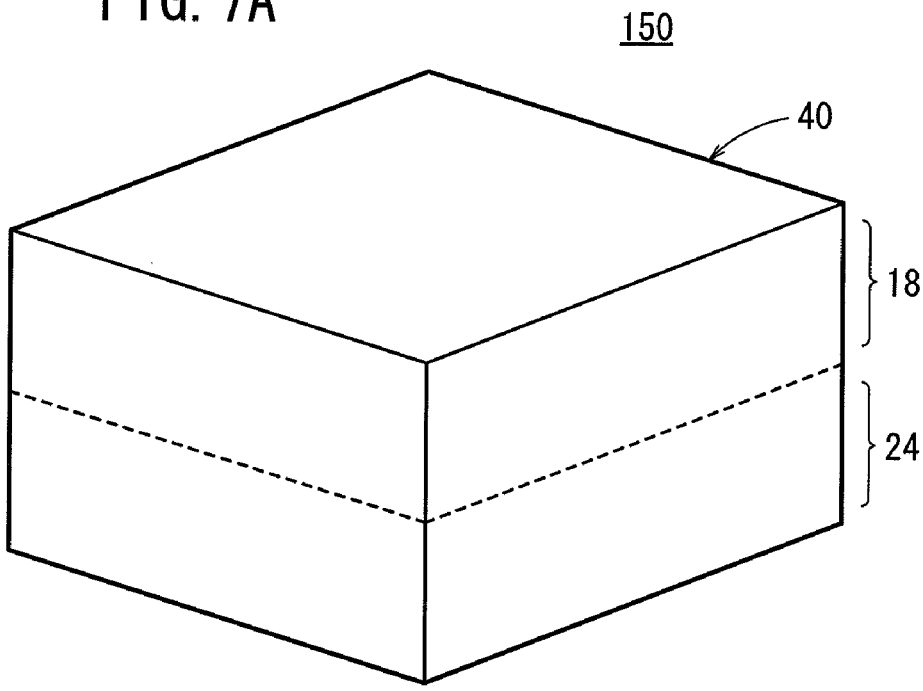
FIG. 7A is a perspective view of a passive component according to a comparative example.
Figure 7B:
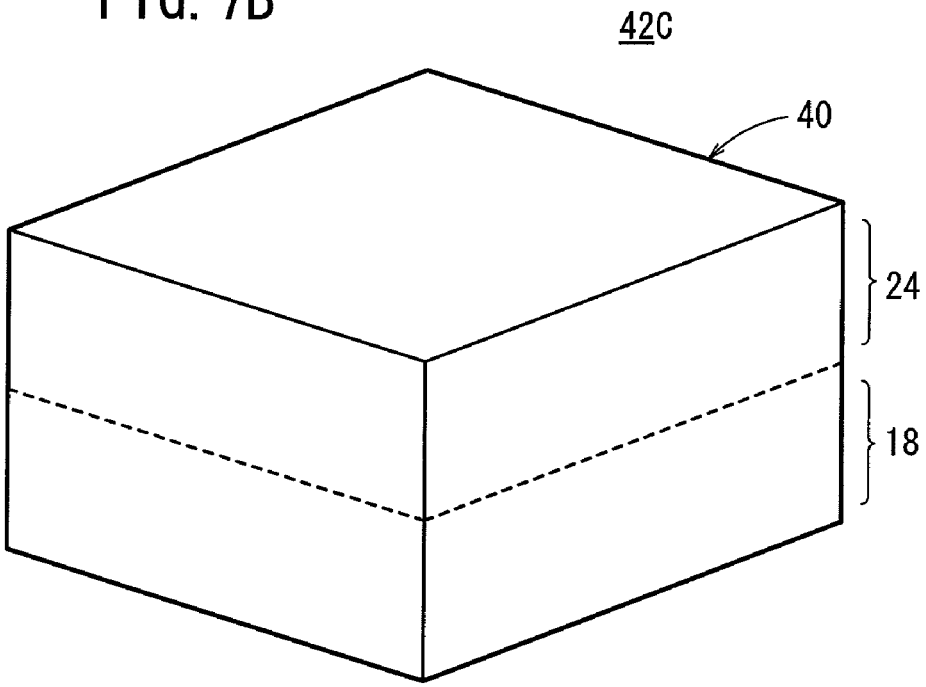
FIG. 7B is a perspective view of a passive component according to an inventive example.

As shown in FIG. 7A, a passive component 150 according to the comparative example comprises a filter 18 disposed in an upper region of a dielectric substrate 40 along the stacking direction, and a converter 24 disposed in a lower region of the dielectric substrate 40 along the stacking direction. As shown in FIG. 7B, a passive component 42C according to the inventive example has a structure similar to that of the passive component 42B according to the present embodiment, and comprises a converter 24 disposed in an upper region of a dielectric substrate 40 along the stacking direction, and a filter 18 disposed in a lower region of the dielectric substrate 40 along the stacking direction.

Figure 8:
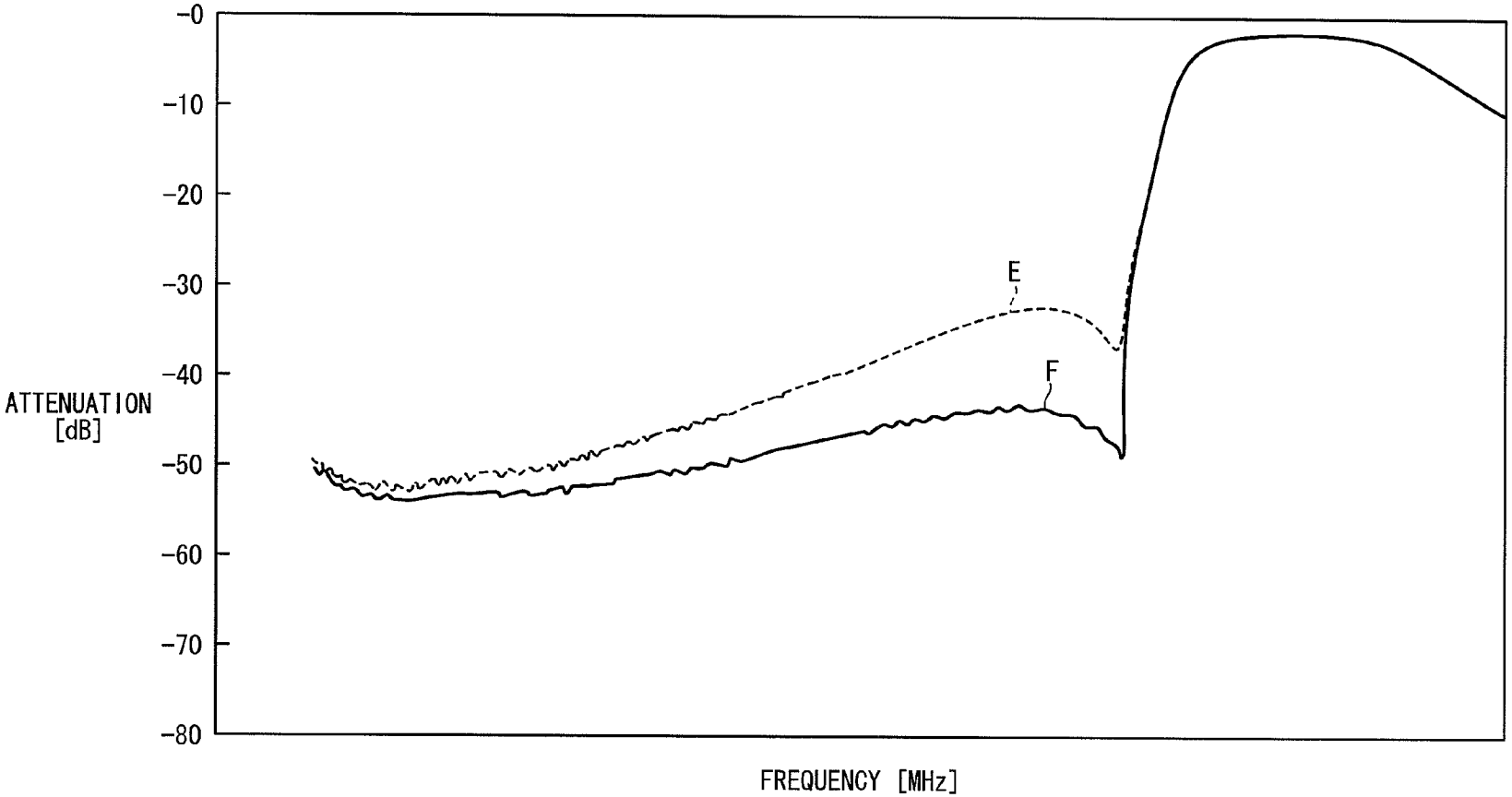
FIG. 8 is a diagram showing the attenuation characteristics of the comparative and inventive examples.

Experimental results are shown in FIG. 8. In FIG. 8, the broken-line curve E represents attenuation characteristics of the passive component 150 according to the comparative example, whereas the solid-line curve F represents attenuation characteristics of the passive component 42C according to the inventive example. It can be seen from FIG. 8 that the inventive example has a larger attenuation level within the blocking range than the comparative example, while also exhibiting sharp attenuation characteristics.

The passive component 10 according to the present embodiment has the basic advantages as described above. The passive component 42B according to the second specific example offers the following other advantages:

The dielectric substrate 40 may be constructed from a plurality of stacked dielectric layers made up of different types of dielectric materials. For example, a dielectric layer having a high dielectric constant may be used where a strong electromagnetic coupling is to be provided, and a dielectric layer having a low dielectric constant may be used where a weak electromagnetic coupling is to be provided. By using materials having desired dielectric constants, the freedom with respect to thickness is increased, thereby achieving a low-profile passive component.

For example, if the dielectric substrate 40 is fabricated by stacking and sintering a plurality of dielectric layers having the same dielectric constant (e.g., $\in$=25), then the demand for a reduced capacitance between the output resonator electrode 114 and the first capacitor electrode 92 may be met by increasing the number of dielectric layers between the output resonator electrode 114 and the first capacitor electrode 92. However, the increased number of dielectric layers is disadvantageous in that it acts against making the passive component 42B low in profile.

If a dielectric layer having a low dielectric constant (e.g., $\in$=7) is used between the output resonator electrode 114 and the first capacitor electrode 92, then since a single dielectric layer may be interposed, an advantage results in that the passive component 42B is made low in profile.

It is also preferable to use dielectric layers having a low dielectric constant (e.g., $\in$=7) as the dielectric layers (the fourth through sixth dielectric layers S4 through S6) of the converter 24, and also to use dielectric layers having a high dielectric constant (e.g., $\in$=25) as the dielectric layers (the seventh through thirteenth dielectric layers S7 through S13) of the portion that provides the capacitance for the filter 18.

In this case, the electrode area of the filter 18 can be reduced, along with decreasing stray coupling of the converter 24.

The passive component according to the present invention is not limited to the above embodiment, but may include various other structures without departing from the gist of the present invention.

The invention claimed is:

1. A passive component comprising a filter according to an unbalanced input/unbalanced output system, having at least one resonator and an unbalanced to balanced converter, wherein a plurality of electrodes make up said filter;

a plurality of striplines make up said unbalanced to balanced converter;

a first capacitor electrode provides a capacitive coupling between an electrode of an output of said filter and a stripline of an input of said unbalanced to balanced converter;

a second capacitor electrode provides a capacitive coupling between an electrode of an input of said filter and the stripline of the input of said unbalanced to balanced converter;

said plurality of electrodes, said plurality of striplines, said first capacitor electrode and said second capacitor electrode are disposed in a dielectric substrate made up of a plurality of stacked dielectric layers;

the electrode of the input of said filter comprises an input resonator electrode of an input resonator;

the electrode of the output of said filter comprises an output resonator electrode of an output resonator;

said first capacitor electrode faces toward said output resonator electrode with one of the plurality of stacked dielectric layers interposed therebetween;

said second capacitor electrode faces toward said input resonator electrode with another of the plurality of stacked dielectric layers interposed therebetween;

said first capacitor electrode and said second capacitor electrode are disposed on different respective dielectric layers of the plurality of stacked dielectric layers; and said first capacitor electrode and said second capacitor electrode are electrically connected to each other through a via hole.

2. A passive component according to claim 1, wherein a position of an attenuation pole in a low range of frequency characteristics is adjustable by said second capacitor.

3. A passive component according to claim 1, wherein an innerlayer ground electrode is disposed between the stripline of the input of said unbalanced to balanced converter, and said first capacitor electrode and said second capacitor electrode.

4. A passive component according to claim 1, wherein said filter and said unbalanced to balanced converter are integrally combined with each other within said dielectric substrate; and said unbalanced to balanced converter is disposed in an upper region of said dielectric substrate along a stacking direction of said dielectric layers, and said filter is disposed in a lower region of said dielectric substrate along the stacking direction of said plurality of stacked dielectric layers.

5. A passive component according to claim 4, wherein said plurality of stacked dielectric layers of said dielectric substrate are made from different types of dielectric materials.

* * * * *